US006182822B1

(12) United States Patent
Albisetti

(10) Patent No.: US 6,182,822 B1
(45) **Date of Patent: *Feb. 6, 2001**

(54) ASSEMBLY OF TWO ELEMENTS MOUNTED TO ROTATE FREELY ONE WITH RESPECT TO THE OTHER IRREVERSIBLY

(75) Inventor: Nicolas Albisetti, Clichy (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/143,652

(22) Filed: Aug. 31, 1998

(30) Foreign Application Priority Data

Aug. 29, 1997 (FR) ..... 97 10819

(51) Int. Cl.[7] ..... B65D 25/08

(52) U.S. Cl. ..... 206/221; 206/568; 215/330; 215/DIG. 8

(58) Field of Search ..... 206/219–221, 206/222, 568; 215/DIG. 8, 263, 330

(56) References Cited

U.S. PATENT DOCUMENTS

| | | | | |
|---|---|---|---|---|
| 4,275,817 | * | 6/1981 | Patton | 215/330 |
| 4,460,100 | | 7/1984 | Libit . | |
| 5,494,174 | * | 2/1996 | Rohr et al. | 215/330 |
| 5,613,623 | * | 3/1997 | Hildebrandt | 206/221 |
| 5,690,241 | * | 11/1997 | Montgomery | 215/263 |
| 5,722,545 | * | 3/1998 | Rinne | 215/330 |
| 5,845,798 | * | 12/1998 | Carrier | 215/330 |
| 5,875,888 | * | 3/1999 | Albisetti | 206/221 |
| 5,875,889 | * | 3/1999 | Albisetti | 206/221 |

FOREIGN PATENT DOCUMENTS

| | | |
|---|---|---|
| 4428096 A1 | 2/1996 | (DE) . |
| WO 96/28361 | 9/1996 | (WO) . |

* cited by examiner

*Primary Examiner*—Luan K. Bui
(74) *Attorney, Agent, or Firm*—Oblon, Spivak, McClelland, Maier & Neustadt, P.C.

(57) ABSTRACT

An assembly includes a first element provided with a snap-fitting bead; and a second element having a snap-fitting lip, capable of passing over the snap-fitting bead so as to allow the second element to be mounted on the first element so that it can rotate freely. The assembly includes structure for allowing the snap-fitting lip to pass over the snap-fitting bead when the assembly is fitted together. By rotating the first element with respect to the second, the structure for allowing the lip to pass over the snap-fitting bead is inoperative for taking the assembly apart.

18 Claims, 4 Drawing Sheets

ASSEMBLY OF TWO ELEMENTS MOUNTED TO ROTATE FREELY ONE WITH RESPECT TO THE OTHER IRREVERSIBLY

BACKGROUND OF THE INVENTION

1. Field of the Invention

The present invention relates to an assembly of two elements mounted one on the other nonremovably (under normal conditions of use) and free to rotate one with respect to the other. The invention is most specifically aimed at arrangements of two or more elements which, especially because of their low strength in terms of axial compression, could not be fitted together by conventional snap-fitting. This is the case, in particular, when the body of one or the other of the elements consists of a bellows. The invention is particularly adapted to the production of a mixer of the kind used in the field of hair dyeing, although other applications may be envisaged.

This application claims priority of French Patent Application No. 9710819 which is hereby incorporated by reference.

2. Discussion of the Related Art

The irreversible stoppering of containers, containing, for example, samples for medical use, is known. By way of example, mention may be made of U.S. Pat. Nos. 4,736,859, 4,799,597 or 4,934,547, which describe the nonremovable, except by destruction, attachment of a lid of a beaker used for collecting urine.

Elsewhere, in particular, in the field of packaging, it is frequent, when a first part is to be fitted onto a second so that it is free to rotate, for the parts to be fitted together by the so-called snap-fitting technique. This technique consists in providing a snap-fitting bead on the outer wall of one of the parts, the bead being capable of having one or more snap-fitting lips or rings formed on the inner wall of the other part which pass over them. For this technique, axial pressure is exerted on the part that has the lips, which pressure, by elastic deformation of the part that has the lips, causes the lips to pass over the bead.

This technique, although satisfactory for a great many applications, proves entirely unsuitable when one and/or the other of the parts to be assembled is too flexible in terms of compression. This happens because assembly by conventional snap-fitting could lead to irreversible deformation of one and/or the other of the parts due to the axial thrust it requires.

A closure system of the snap-fitting type is also described in U.S. Pat. No. 4,460,100. This document describes a closure device in which the stopper comprises a snap-fitting lip and a snap-fitting bead, which consist of a continuous rib from which there originates a number of ramps oriented respectively so as to come into mutual engagement as the stopper is rotated with respect to the container. One of the problems associated with a design of this kind stems from the fact that, because of the presence of the continuous rib, the ramps of the stopper cease being in engagement with the ramps of the container when the rib of one is positioned over the rib of the other, which in certain cases may require axial pressure to be exerted on the stopper in order to finish the passage of the snap-fitting lip over the snap-fitting bead.

In WO 96/28321, the snap-fitting lip and the snap-fitting bead are produced in the form of one or more helical screw threads extending over the entire periphery of the neck of the bottle, forming an angle with respect to the plane perpendicular to the axis of rotation. The snap-fitting lip can pass over the snap-fitting bead, essentially, only by screwing. This occurs because such screw threads define on the periphery two or more superposed ribs, which can be passed over only by following the thread. Put another way, almost all of the snap-fitting lip passes over the snap-fitting bead in rotation, following the screw thread from its entry to its exit. It is not possible to pass over a significant part of the snap-fitting bead by an axial movement. Such a design entails a substantial angle of rotation in order to achieve such an assembly.

SUMMARY OF THE INVENTION

Thus, an object of the present invention is to provide an assembly of two elements which are mounted so that they can rotate freely one on the other, nonremovably, while requiring appreciably no axial pressure of one on the other in order to fit the elements together.

A particular object of the invention is to allow the snap-fitting lip to pass swiftly and axially over the snap-fitting bead in response only to a small angular rotation of the first element with respect to the second.

Another object of the invention is to provide an assembly that constitutes a device for the extemporaneous mixing of two products.

A further object of the invention is to provide an assembly that is economical, simple to produce and to fit together, and reliable.

Other objects will become apparent in the detailed description which follows.

According to the invention, these objects are achieved by producing an assembly comprising: a first element, one portion of which is provided with a snap-fitting bead; and a second element comprising a snap-fitting lip, capable of passing over the snap-fitting bead so as to allow the second element to be mounted on the first element so that it can rotate freely. According to the invention, the snap-fitting bead and the snap-fitting lip extend respectively in a plane perpendicular to an axis of symmetry of the invention or axis X and each have at least one opening delimited by a first end forming a ramp portion and a second end extending in the plane perpendicular to the axis X, at least one ramp portion of the snap-fitting bead being capable, when the assembly is fitted together, in response to a rotation of the first element with respect to the second element about the axis, of engaging via its respective opening with an associated ramp portion of the snap-fitting lip and of allowing the snap-fitting lip to pass over the snap-fitting bead.

According to the invention, the snap-fitting lip passes over the snap-fitting bead outside of the openings in the bead, by making the straight portions (that is to say the portions oriented in the plane perpendicular to the axis X) of the snap-fitting lip pass "axially" over the corresponding straight portions of the snap-fitting bead in response to the axial tension generated by the engagement of the ramps of the first element with the ramps of the second element via their respective openings.

Advantageously, there is appreciably no angular overlap between the at least one ramp portion and the snap-fitting lip or snap-fitting bead respectively. The snap-fitting lip is, thus, able to pass over the snap-fitting bead in a movement that has an essentially axial component, while keeping the ramp portions in mutual engagement throughout this passage or movement. Advantageously, the openings are oriented along an axis which is not appreciably parallel to the planes respectively containing the snap-fitting lip and the snap-fitting bead, the axis being parallel to a mean axis of the ramp. The angle of rotation necessary for the snap-fitting lip to pass over the snap-fitting bead is thus considerably reduced. Typically, the mean angle formed by the axis of the opening with respect to the plane perpendicular to the axis X is of the order of 20° to 50°, and preferably of the order of 45°.

An arrangement of this kind makes it possible, when fitting the assembly together, for the lip to pass over the snap-fitting bead, essentially by relative rotation of the first element with respect to the second element. The means are inoperative once the assembly has been fitted together, because the portions of the lip and of the bead, which are perpendicular to the axis of rotation, prevent any passage of the lip over the snap-fitting bead in the opposite direction (under normal conditions of use); once the lip has passed over the snap-fitting bead, the ramp portions are oriented away from each other. Producing the snap-fitting lip and the bead in a discontinuous shape makes it possible to keep the ramp portions of the snap-fitting lip in mutual engagement through the event of the lip passing over the snap-fitting bead. Thus, a mere rotation of one of the elements with respect to the other is enough to allow the assembly to be fitted together. It is not necessary to exert any axial pressure in order to finish the passage and achieve the fitting. The passage of the lip over the snap-fitting bead takes place over a relatively small angular rotation. This occurs because the passage of the lip over the snap-fitting bead is the sole result of the axial tension resulting from the engagement of the ramps of the snap-fitting bead with the complementary ramps of the snap-fitting lip.

Advantageously, the snap-fitting bead and the snap-fitting lip each comprise at least two ramps angularly separated by at least two portions extending in a plane perpendicular to an axis, each of the portions having a first end adjacent to one of the ramps and a second end situated some distance from the other ramp so as to delimit an opening to allow the ramps of the snap-fitting lip to engage with the ramps of the snap-fitting bead via their respective openings in response to a rotation of the first element with respect to the second element about said axis, and keeping them in engagement throughout the event of the snap-fitting lip passing over the snap-fitting bead.

In one embodiment, the ramps each form a portion of a helical screw thread.

However, according to a preferred embodiment, the ramps each form an arc of a circle. Such an arrangement makes it possible to reduce, still further, the angle of rotation needed for the lip to pass over the snap-fitting bead.

Advantageously, the snap-fitting bead and the snap-fitting lip each have three ramps spaced uniformly at their periphery. Thus, three openings spaced 120° apart are defined. The quick engagement of the ramp portions of the snap-fitting bead with the ramp portions of the snap-fitting lip thus becomes easier.

By way of example, the snap-fitting bead and the snap-fitting lip each have three ramp portions, as well as three openings angularly spaced by 120°.

Advantageously, the first element is formed of a container capable of containing at least one liquid or semi-liquid product, the second element consisting of an operating member.

More advantageously, the container has a body, one end of which is surmounted by a dispensing adaptor removably closed by a stopper, the stopper being, in a first axial position, contained inside a cap forming the second element and, in a second axial position, emerging from the cap through an orifice made in a free end of the cap. The rotation, in a first direction, of the cap with respect to the container causes the stopper to move from the first position into the second position.

The dispensing adaptor may be screwed onto a neck surmounting the body. The rotation of the cap in the first direction with respect to the body causes the adaptor to be unscrewed and the stopper to move up axially. Means are provided for preventing the cap from rotating with respect to the dispensing adaptor. The stopper may be held on the adaptor by any appropriate means, for example by snap-fitting. For unstable mixtures, they must be used just after they have been mixed. For this type of mixing, it is desirable for it not to be possible for the adaptor to be screwed back inside the cap, so that the user will not be tempted to use the contents in several operations. For this situation, the adaptor is disengaged from the cap when the cap is rotated in the opposite direction.

According to a particularly advantageous embodiment, the container is a device for the extemporaneous mixing of at least two compounds, the device comprising: a first container containing a product A, the first container being surmounted by an adaptor for dispensing the mixture; a second container containing a product B; removable closure means for isolating the first container from the second container; and actuating means for expelling the closure means and mixing the products A and B.

The snap-fitting bead may be formed on an outer wall of the body of the first container, said snap-fitting lip being formed on an inner wall of the cap close to an end opposite the free end.

Advantageously, the mixture is a hair composition. By way of example, the product A is an oxidizing agent and the product B is a dye.

The assembly according to the invention may be obtained by molding thermoplastics (injection blow-molding or extrusion blow-molding). By way of nonlimiting examples, mention may be made of polyethylenes, polypropylenes, polyvinyl chlorides, or complexes of the PE/EVOH/PE type.

BRIEF DESCRIPTION OF THE DRAWINGS

Apart from the provisions explained hereinabove, the invention consists in a certain number of other provisions which will be explained hereafter, with respect to nonlimiting embodiments which are described with reference to the appended Figures, among which.

DESCRIPTION OF THE PREFERRED EMBODIMENTS

Figure 1A:
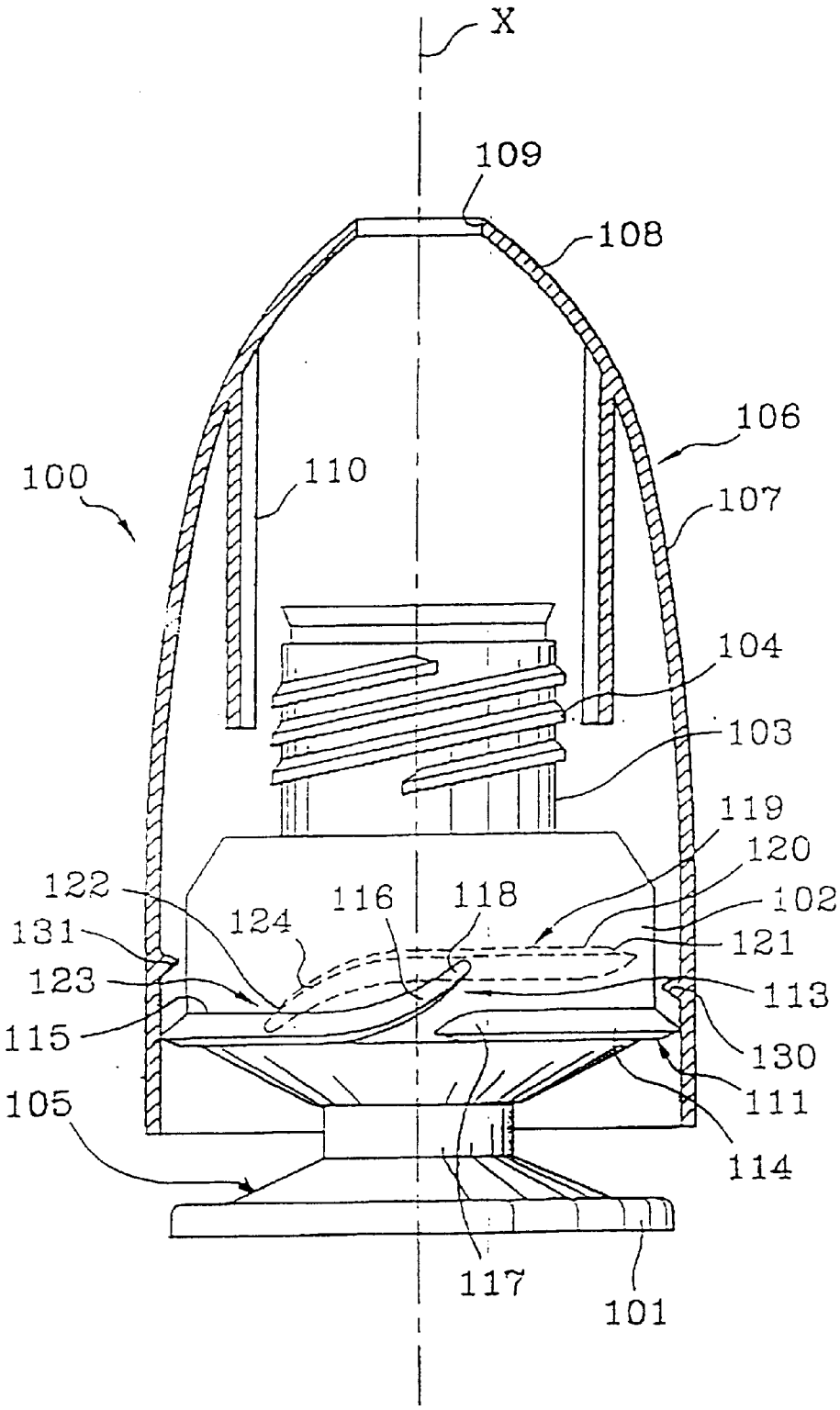
FIGS. 1A, 1B and 1C illustrate a first embodiment of the assembly according to the invention, and the stages involved in fitting together the two elements that constitute the assembly.
Figure 1B:
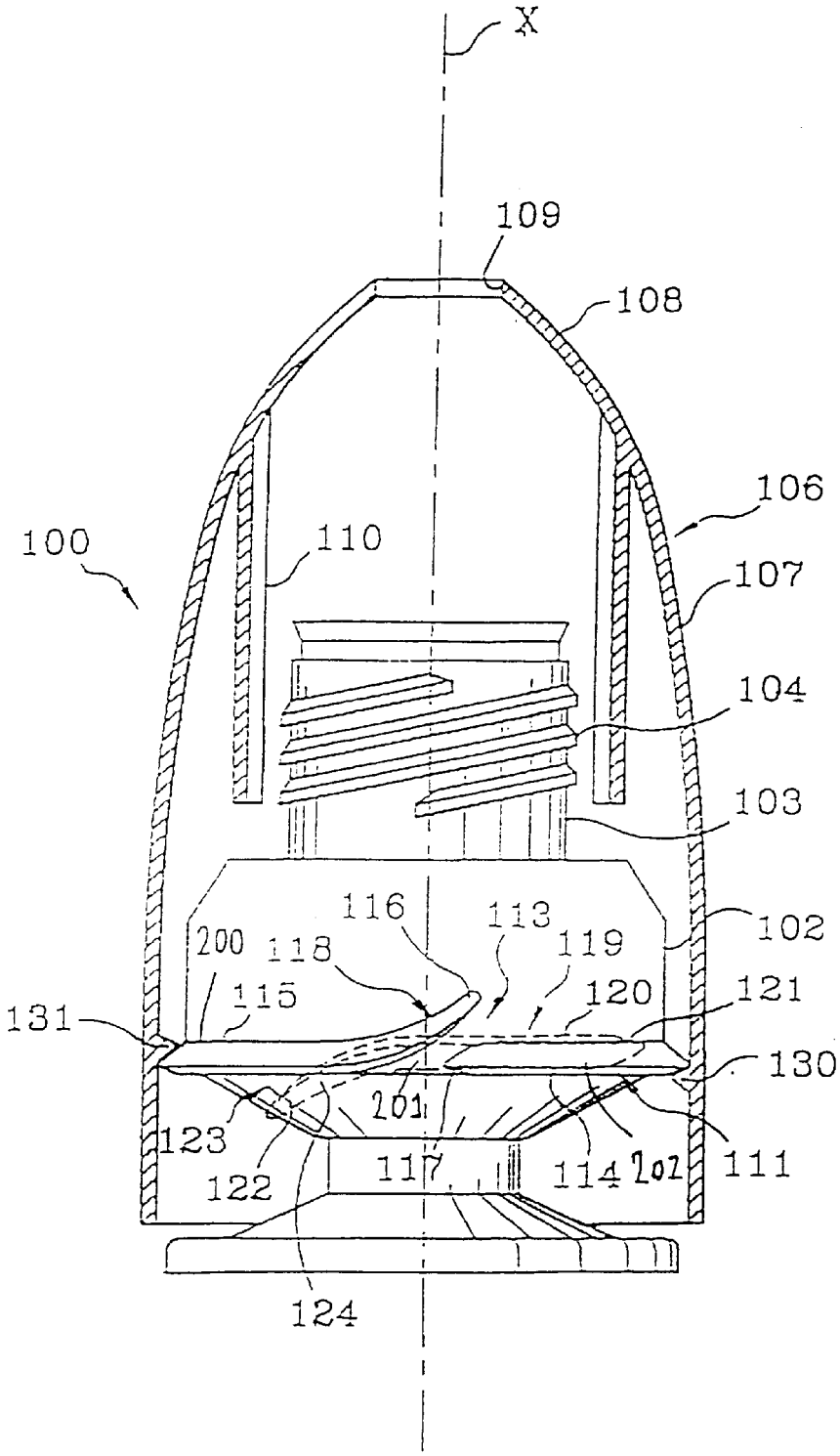
Figure 1C:
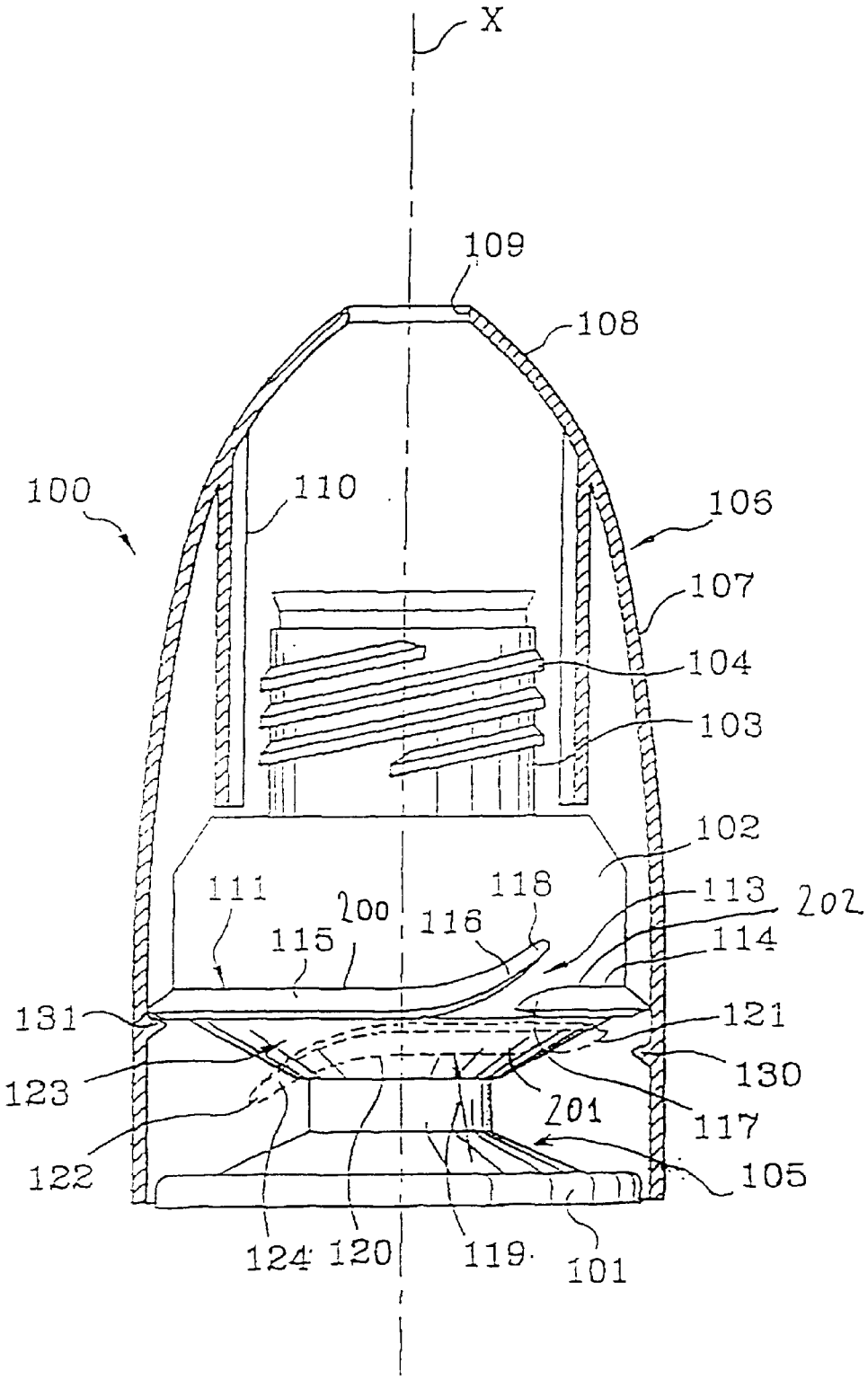

In the embodiment of FIGS. 1A to 1C, the assembly 100 is in the form of a mixer, of which the only parts depicted are those which form part of the invention, namely, in the main, the device for fitting one of the components on the other.

Having an axis X of symmetry, an assembly 100 comprises a first element 105 consisting of a lower bottle 101 (depicted partially) and of an upper bottle 102. The bottle 102 has one of its ends surmounted by a neck 103. The neck 103 has a screw thread 104 capable of receiving a dispensing adaptor (not shown), which will be discussed in greater detail with reference to FIGS. 2 and 3. The relative arrangement of the two bottles does not form part of the invention, and will be described in greater detail with reference to FIGS. 2 and 3.

The assembly 100 also comprises a second element 106 consisting of a cap 107 capable of covering the dispensing adaptor. The cap 107 is of oblong shape, tapered towards its free end 108. The free end 108 has an orifice 109 for, as will be seen in greater detail later, receiving a removable stopper carried by the dispensing adaptor. The cap 107 comprises a tab 110, capable of interacting with an axial slot formed in the dispensing adaptor so as to produce rotational coupling between the cap 107 and the dispensing adaptor.

Figure 2:
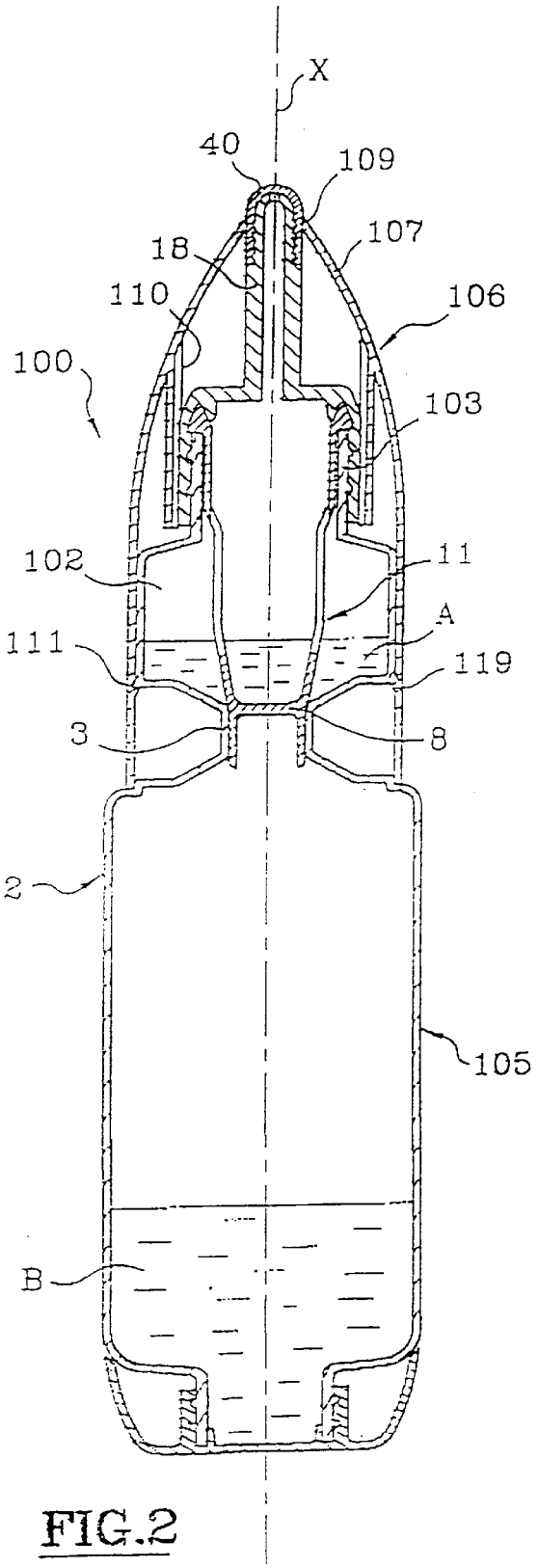
FIGS. 2 and 3 illustrate a detailed embodiment of an assembly according to the invention, which consists of a mixer, as used in the field of hair dyeing.
Figure 3:
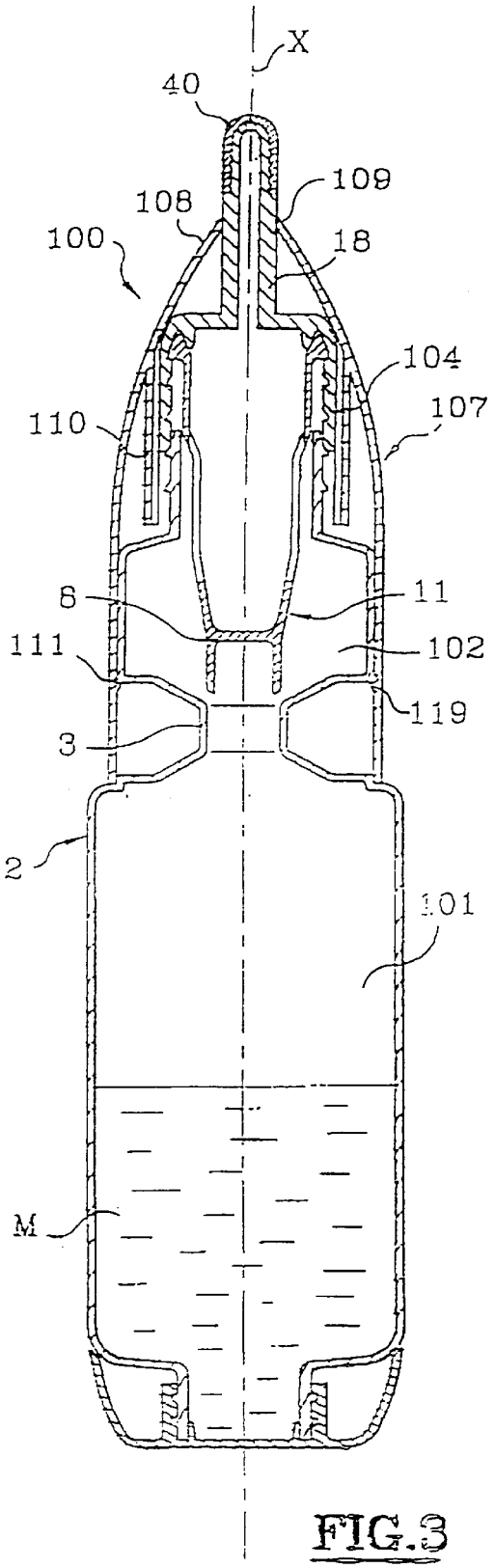

Thus, the cap 107 constitutes an operating member for axially driving the dispensing adaptor in order, on the one hand, to allow the respective contents of the bottles 101 and 102 of FIGS. 2 and 3 to be mixed, and, on the other hand, at the same time, to give access to the stopper, once mixing has taken place, and thus allowing it to be dispensed. The cap 107 must therefore be free to rotate with respect to the mixer body. It must also be axially immobile and nonremovable, at least under normal conditions of use.

For this movement, according to the invention, the cap 107 is fitted on in the way which will now be described in greater detail. A "snap-fitting bead" 111 is produced over approximately the entire periphery of the body of the bottle 102, near its lower end, and extending in a plane perpendicular to the axis X. At this point at least, the cross-section of the bottle 102 is circular. The snap-fitting bead 111 can be distinguished from conventional snap-fitting beads in that it is interrupted at three points on its circumference so as to form three openings or entries 113 in FIGS. 1A–1C spaced angularly by 120°. Thus, the snap-fitting bead 111 is in actual fact made up of three portions 114, 115 (the third not being visible in the drawing), of approximately identical angular width, and oriented perpendicular to the axis X. Each entry 113 is delimited by a rear end 116 of the portion 115 and a front end 117 of the portion 114 adjacent to the rear end 115. The front end 117 of the portion 114 is aligned with the bead 111, that is to say approximately perpendicular to the axis X of the assembly, while the rear end 116 of the adjacent portion 115 forms a ramp facing the top of the device, where the ramp forms a short portion of a helical screw thread or of a thread in the shape of an arc of a ramp 118. This arrangement contributes to orienting the entries 113, which cannot be passed over except in just one direction of rotation. In FIG. 1B, each bead portion 114, 115 consists of a straight portion 200, 202, approximately perpendicular to the axis X, delimited by the front end 117, aligned with the central portion, and having the curved rear end 116, defining a ramp oriented towards the neck 103 of the bottle 102. Within the meaning of this description, the ideas of "front" and "rear" are relative, and depend solely on the direction of rotation. The ramp 118 forms a mean angle of the order of 45°, and extends in such a way that it does not appreciably angularly overlap the adjacent portion 114. In other words, the projection of the free rear end 116 of the ramp 118 onto a plane perpendicular to the axis X lies near the front end 117 of the bead portion 114.

In the same way, the internal surface of the cap 107 is provided with a lip 119 which also consists of three portions 120, 130, 131, arranged in a plane perpendicular to the axis X, the cap 107 at this point being of circular cross-section. Each portion 120, 130, 131 consists of a central portion 201 approximately perpendicular to the axis X, delimited by a rear end 121 aligned with the central portion 201, and a curved front end 122 defining a ramp which, when the cap 107 is placed on the assembly, faces in the opposite direction to, but lies opposite, the ramps formed by the bead 111. Thus, the lip 119 also has three openings 123 spaced angularly 120° apart. Each opening 123 is delimited by the rear end 121 of a portion 131 and the curved front end 122 of the portion 120 adjacent to the said rear end 121. As already mentioned, the curved front end 122 of the portion 120 forms a ramp facing the lower part the bottle 102, while the rear end 121 of the portion 130 is aligned with the lip 119, that is to say approximately perpendicular to the axis X of the assembly 100. In the same way as for the bead 111, the ramps formed by the lip 119 also form portions of a screw thread (helical or circular) 124 that complement the ramp 118 formed by the bead 111, so that as the cap 107 is rotated with respect to the first element 105 in FIG. 1A, they can engage with one another via the entry 113 and the openings 123 and cause an axial movement of the cap 107 with respect to the first element 105, causing the straight portions 201 of the snap-fitting bead 111 in FIG. 1B to pass over the straight portions 200, 202 of the snap-fitting bead 111. The axial movement is approximately equal to the axial height of the ramps. In the embodiment illustrated, the portions 120, 130, 131, formed by the lip 119, are spaced further apart than the portions 114, 115 formed by the bead 111. For this lip 119, there is no angular overlap between the portions 120, 130, 131. Thus, forceful demolding of the cap 107 becomes easier, while at the same time allowing the cap 107 to be held firmly on the bottle 102.

In the position illustrated in FIG. 1A, the entry of the screw thread 124 is angularly offset with respect to the entry of the ramp 118 of the bead 111. By turning the cap 107 with respect to the device, in the clockwise direction (FIG. 1B), the screw thread 124 is brought into engagement with the portion of the ramp 118 via the respective entries 113 and openings 123, which screw thread 124 and ramp 118 slide along one another, causing an axial movement of the cap 107 with respect to the bottle 102. By continuing to turn the cap 107 in the same direction (FIG. 1C), the axial movement continues until the lip 119 has completely passed over the bead 111, the screw thread 124 and the ramp 118 remaining in engagement throughout the passage, the making it possible for this passage to be achieved without having to exert the slightest axial pressure on the cap 107. At this stage, the lip 119 is passed under the bead 111. The entries 113 and openings 123 still face in opposite directions to one another, but are no longer opposite each other, which prevents them from passing over one another in the opposite direction (dismantling) irrespective of the direction in which the cap 107 is rotated with respect to the bottle 102. Thus, the cap 107 is fitted without any axial force, simply by rotating, in the manner of screwing. The cap 107 is unable to move axially with respect to the first element 105, but is free to rotate. The cap 107 cannot be removed, unless a pulling force inconsistent with the normal conditions of use is exerted.

Reference is now made to FIGS. 2 and 3 which depict more fully a device for the extemporaneous mixing of two products A and B. The assembly 100 comprises a body 2 in FIG. 2 delimiting a lower bottle 105 containing the product B, and the upper bottle 102, containing the product A. The two bottles 102 and 105 are separated by a restriction 3 closed by a removable member 8 carried by a free end of a coupling element 11 secured to an adaptor 18. The adaptor 18 is screwed onto a neck 103 of the upper bottle 102 and is coupled in terms of rotation with the cap 107 by the tab 110 carried by the cap 107. The dispensing adaptor 18 is closed by a screwed plug 40 which, prior to mixing (FIG. 2) is almost fully housed inside the cap 107, thus preventing the screwed plug 40 from being opened in this position.

The cap 107 comprises the snap-fitting lip 119, of the type described with reference to FIGS. 1A–1C. The lip 119 is located near the lower part of the cap 107, on its inner wall. The upper bottle 102 on its outer surface, near its lower end, comprises the snap-fitting bead 111, of the type described with reference to FIGS. 1A–1C. The cap 107 is fitted onto the body 2 in the way discussed earlier, and no additional description of this fitting is therefore required.

In order to carry out mixing and use of the mixture, the user rotates the cap 107 with respect to the body 2 of the mixer. This rotational movement unscrews the adaptor 18 and causes it to move up axially. This axial movement also causes the removable member 8 to move up, via the coupling element 11, and uncovers the opening delimited by the restriction 3. Product A drops into the bottle 101 in FIG. 3, thus producing a mixture M. The upward axial movement of the adaptor 18 causes the plug 40 to emerge from the cap 107. The plug 40 can therefore be unscrewed, and the mixture M can be applied.

In the foregoing detailed description, reference was made to preferred embodiments of the invention. It is obvious that variations can be made thereon without departing from the spirit of the invention as claimed hereafter. Although the only embodiments to have been described relate to mixers, it is obvious that the invention is not restricted to such applications. In practice, it is aimed at any arrangement of two elements, one of which is to be fitted onto the other so that it can rotate freely, and nonremovably. Such an invention may, in particular, find an application in the field of foodstuffs, toys, and the like.

What is claimed is:

1. An assembly having a longitudinal axis, the assembly comprising:

a first element including a snap-fitting bead, said snap-fitting bead extending in a first plane perpendicular to the longitudinal axis and having at least one opening delimited by a first end forming a ramp portion and a second end extending in said first plane; and a second element including a snap-fitting lip, said snap-fitting lip extending in a second plane perpendicular to the longitudinal axis and having at least one opening delimited by a first end forming a ramp portion and a second end extending in said second plane, said at least one opening of said snap-fitting lip being complementary with said at least one opening of said snap-fitting bead;

wherein, when said first element and said second element of the assembly are fitted together, said ramp portion of said at least one opening of said snap-fitting bead engages said ramp portion of said complementary at least one opening of said snap-fitting lip in response to a rotation of said first element with respect to said second element so that said snap-fitting lip passes over said snap-fitting bead, thus allowing said second element to be mounted on said first element irreversibly so that said second element can rotate freely;

wherein there is an unblocked gap between said ramp portion of said at least one opening of said snap-fitting bead and said second end of said snap-fitting bead with which said ramp portion defines said at least one opening of said snap-fitting bead; and wherein there is an unblocked gap between said ramp portion of said at least one opening of said snap-fitting lip and said second end of said snap-fitting lip with which said ramp portion defines said at least one opening of said snap-fitting lip.

2. The assembly according to claim 1, wherein said at least one openings of said snap-fitting bead and of said snap-fitting lip each comprise at least two openings forming at least two ramp portions angularly separated by at least two portions extending in one and the same plane perpendicular to the axis of symmetry, each of said at least two portions having a first end adjacent to one of said at least two ramp portions and a second end situated a distance from the other of said at least two ramp portions so as to delimit each of said at least two openings to allow said at least two ramp portions of said snap-fitting lip to engage with said at least two ramp portions of said snap-fitting bead via their respective at least two openings in response to the rotation of said first element with respect to said second element, and to keep them in engagement throughout the event of the snap-fitting lip passing over the snap-fitting bead.

3. The assembly according to claim 1, wherein said ramp portions each form a portion of a helical screw thread.

4. The assembly according to claim 1, wherein said ramp portions each form an arc of a small circle such that an angle of the rotation necessary for the snap-fitting lip to pass over the snap-fitting bead is in an order of 20° to 50°.

5. The assembly according to claim 1, wherein said at least one openings of said snap-fitting bead and of said snap-fitting lip each include three openings spaced uniformly at respective peripheries of said first and second elements.

6. The assembly according to claim 1, wherein said first element is formed of a container capable of containing at least one liquid or semi-liquid product, and said second element including an operating member.

7. The assembly according to claim 1, wherein the assembly is obtained by molding a thermoplastic material.

8. The assembly according to claim 2, wherein the assembly is obtained by molding a thermoplastic material.

9. The assembly according to claim 3, wherein the assembly is obtained by molding a thermoplastic material.

10. The assembly according to claim 4, wherein the assembly is obtained by molding a thermoplastic material.

11. The assembly according to claim 5, wherein the assembly is obtained by molding a thermoplastic material.

12. The assembly according to claim 6, wherein the assembly is obtained by molding a thermoplastic material.

13. An assembly having an axis of symmetry, said assembly comprising:

a first element including a snap-fitting bead, said snap-fitting bead extending in a first plane perpendicular to the axis of symmetry and having at least one opening delimited by a first end forming a ramp portion and a second end extending in said first plane; and a second element including a snap-fitting lip, said snap-fitting lip extending in a second plane perpendicular to the axis of symmetry and having at least one opening delimited by a first end forming a ramp portion and a second end extending in said second plane, said at least one opening of said snap-fitting lip being complementary with said at least one opening of said snap-fitting bead;

wherein, when said first element and said second element of the assembly are fitted together, said ramp portion of said at least one opening of said snap-fitting bead engages said ramp portion of said complementary at least one opening of said snap-fitting lip in response to a rotation of said first element with respect to said second element so that said snap-fitting lip passes over said snap-fitting bead, thus allowing said second element to be mounted on said first element so that said second element can rotate freely;

wherein said first element is formed of a container capable of containing at least one liquid or semi-liquid product and wherein said second element includes an operating member;

wherein said container has a body, one end of said body being surmounted by a dispensing adaptor removably closed by a stopper, wherein said stopper, in a first axial position, is contained inside a cap forming said second element and, in a second axial position, emerges from said cap through an orifice made in a free end of said cap, and wherein rotation of said cap in a first direction with respect to said container causes said stopper to move from said first position into said second position.

14. The assembly according to claim 13, wherein said dispensing adaptor is screwed onto a neck surmounting said body, in that rotation of said cap in said first direction with respect to said body causes said adaptor to be unscrewed and said stopper to move up axially, and further comprising means for preventing said cap from rotating with respect to said dispensing adaptor.

15. The assembly according to claim 13, wherein said container is a device for making an extemporaneous mixture of at least two products, said device comprising:

a first container containing a first product of said at least two products and surmounted by said adaptor for dispensing said mixture;

a second container containing a second product of said at least two products;

removable closure means for isolating said first container from said second container; and actuating means for expelling said removable closure means and mixing said first and second products.

16. The assembly according to claim 15, wherein said snap-fitting bead is formed on an outer wall of said body of said first container, and wherein said snap-fitting lip is formed on an inner wall of said cap close to an end opposite said free end of said cap.

17. The assembly according to claim 15, wherein said mixture is a hair composition.

18. The assembly according to claim 17, wherein said first product is an oxidizing agent, and said second product is a dye.

* * * * *